US006253922B1

(12) United States Patent
Hadden

(10) Patent No.: US 6,253,922 B1
(45) Date of Patent: Jul. 3, 2001

(54) CARPET SAMPLE BOOK

(75) Inventor: James W. Hadden, LaGrange, GA (US)

(73) Assignee: Interface, Inc., Atlanta, GA (US)

( * ) Notice: Subject to any disclaimer, the term of this patent is extended or adjusted under 35 U.S.C. 154(b) by 0 days.

(21) Appl. No.: 09/445,712

(22) PCT Filed: Jun. 9, 1998

(86) PCT No.: PCT/US98/12052

§ 371 Date: Mar. 2, 2000

§ 102(e) Date: Mar. 2, 2000

(87) PCT Pub. No.: WO98/56690

PCT Pub. Date: Dec. 17, 1998

Related U.S. Application Data

(60) Provisional application No. 60/049,281, filed on Jun. 10, 1997.

(51) Int. Cl.[7] ..... B65D 23/12

(52) U.S. Cl. ..... 206/733; 206/472; 206/487

(58) Field of Search ..... 206/736, 756, 206/759, 760, 763, 766, 767, 774, 214, 472, 476, 486, 487, 730, 733, 734, 747, 750, 449; 229/120.21

(56) References Cited

U.S. PATENT DOCUMENTS

| | | | | |
|---|---|---|---|---|
| D. 160,830 | | 11/1950 | Aron . | |
| 244,818 | * | 7/1881 | McLean | 206/472 |
| 958,218 | | 5/1910 | Benze . | |
| 1,564,152 | | 12/1925 | Thomas . | |
| 1,906,555 | * | 5/1933 | Donnell | 206/472 |
| 1,977,667 | | 10/1934 | Breitkreuz . | |
| 2,126,407 | * | 8/1938 | Payne et al. | 206/750 |
| 2,239,145 | | 4/1941 | Doner . | |
| 2,463,338 | * | 3/1949 | Wechsler | 206/748 |
| 2,833,457 | | 5/1958 | Tyrseck . | |
| 3,138,261 | | 6/1964 | Witteborg . | |
| 3,185,608 | | 5/1965 | Howard . | |
| 3,352,415 | | 11/1967 | Seeley et al. . | |
| 3,514,875 | | 6/1970 | Howard . | |
| 3,532,412 | | 10/1970 | Miller . | |
| 3,620,552 | | 11/1971 | Woodcock et al. . | |
| 3,816,948 | | 6/1974 | Mooney et al. . | |
| 3,841,548 | | 10/1974 | Curley . | |
| 4,063,648 | | 12/1977 | Fuller et al. . | |
| 4,240,761 | | 12/1980 | Jacobson . | |
| 4,651,872 | | 3/1987 | Joyce . | |
| 4,703,943 | | 11/1987 | Zelenko et al. . | |
| 4,880,327 | | 11/1989 | Sanabria . | |
| 5,259,517 | | 11/1993 | Pancoe . | |
| 5,316,138 | * | 5/1994 | Thompson | 206/472 |
| 5,407,076 | * | 4/1995 | Sabet | 206/472 |
| 5,611,433 | | 3/1997 | Levy . | |
| 5,931,301 | | 8/1999 | Hadden et al. . | |

FOREIGN PATENT DOCUMENTS

| | | |
|---|---|---|
| 725422 | 3/1955 | (GB) . |

* cited by examiner

*Primary Examiner*—Luan K. Bui
(74) *Attorney, Agent, or Firm*—John S. Pratt; Michael J. Turton; Kilpatrick Stockton LLP

(57) ABSTRACT

A carpet sample book is provided which is constructed from a single sheet of material, such as cardboard. Tab and slot fasteners are used to avoid the need of adhesives. The samples are supported in the facing pages of the book by slots which are cut into the cardboard surface. The slots are cut in a "C" shape which allows the samples to be held at an angle.

9 Claims, 5 Drawing Sheets

CARPET SAMPLE BOOK

This application is a 371 of PCT/US98/12052 filed Jun. 9, 1998 which claims benefit of Provisional Application No. 60/049,281 filed Jun. 10, 1997.

BACKGROUND OF THE INVENTION

Numerous carpet sample books are available which allow the display of one or more segments of carpet to prospective buyers. Most such sample books display the sample in a flat orientation. As a result, the sample books must be very large or the samples quite small in order to fit an adequate number of samples in the book. Moreover, it may be difficult to compare samples to each other, for the purpose of, for instance, comparing samples to be used in conjunction for a patterned floor treatment. Also, it may be difficult to remove the sample from the book for close examination.

U.S. Pat. No. 5,316,138 to Thompson, entitled "Carpet Display Sample Kit," discloses a sample kit comprising a box and a support tray. The support tray supports numerous carpet samples at an angle, allowing more samples to be contained in a given area and allowing the samples to be compared and contrasted. Also, the samples may easily be removed from the support tray, allowing ease of inspection. The kit of Thompson accommodates only a limited number of samples because only one tray is provided. Moreover, the kit of Thompson is a relatively complex and requires several parts. This may increase the weight of the kit, making it bulky and difficult to carry. Also, the multi-part construction may increase the cost and complexity of manufacture.

Thus, it would be desirable to provide a carpet sample book or case that allows a large number of samples to be carried in a light-weight, inexpensive and easy-to-assemble unit.

SUMMARY OF THE INVENTION

The carpet sample display book of the present invention has two"pages" joined by a spine segment. The entire book may be formed from a single sheet of cardboard or other suitable material. Each page is made by folding a portion of the cardboard sheet over three times. The first two folds form the page itself. The third fold forms the spine of book. Tabs and slots are provided on the folds in order secure the folds in the folded position.

The face of each page is perforated with"C" shaped cuts to form a number of slots with interior louvers. The slot/louver combination allows carpet samples, typically square or rectangular segments, to be inserted into the page and displayed at an angle. Rectangular perforations in the rear or backing face of the page may be provided to allow the samples to be seated in the slots to a greater depth. The rectangular perforations also allow the user to display the backing of the samples without having to remove the samples from the slots.

Because the sample book may be constructed from a single sheet, it is very light weight. Because the sample book may be assembled without adhesives, i.e., with slots and tabs, the manufacture of such sample books is also simple and inexpensive.

Accordingly, it is an object of the invention to provide a carpet sample book that allows numerous samples to be displayed in a relatively small space.

Another object of the invention to provide a carpet sample book that allows numerous samples to be displayed in an overlapping manner so that adjacent samples may be compared to and contrasted with each other.

Another object of the invention to provide a carpet sample book that allows samples to be easily removed from the sample book for closer inspection.

Another object of the invention to provide a carpet sample book which may be constructed from a single sheet of material.

Another object of the invention to provide a carpet sample book which may be assembled without the use of adhesives or other fasteners.

Other objects, features and advantages of the present invention will become apparent with reference to the drawings, the following description of the drawings and the claims.

DETAILED DESCRIPTION OF THE DRAWINGS

Figure 1:
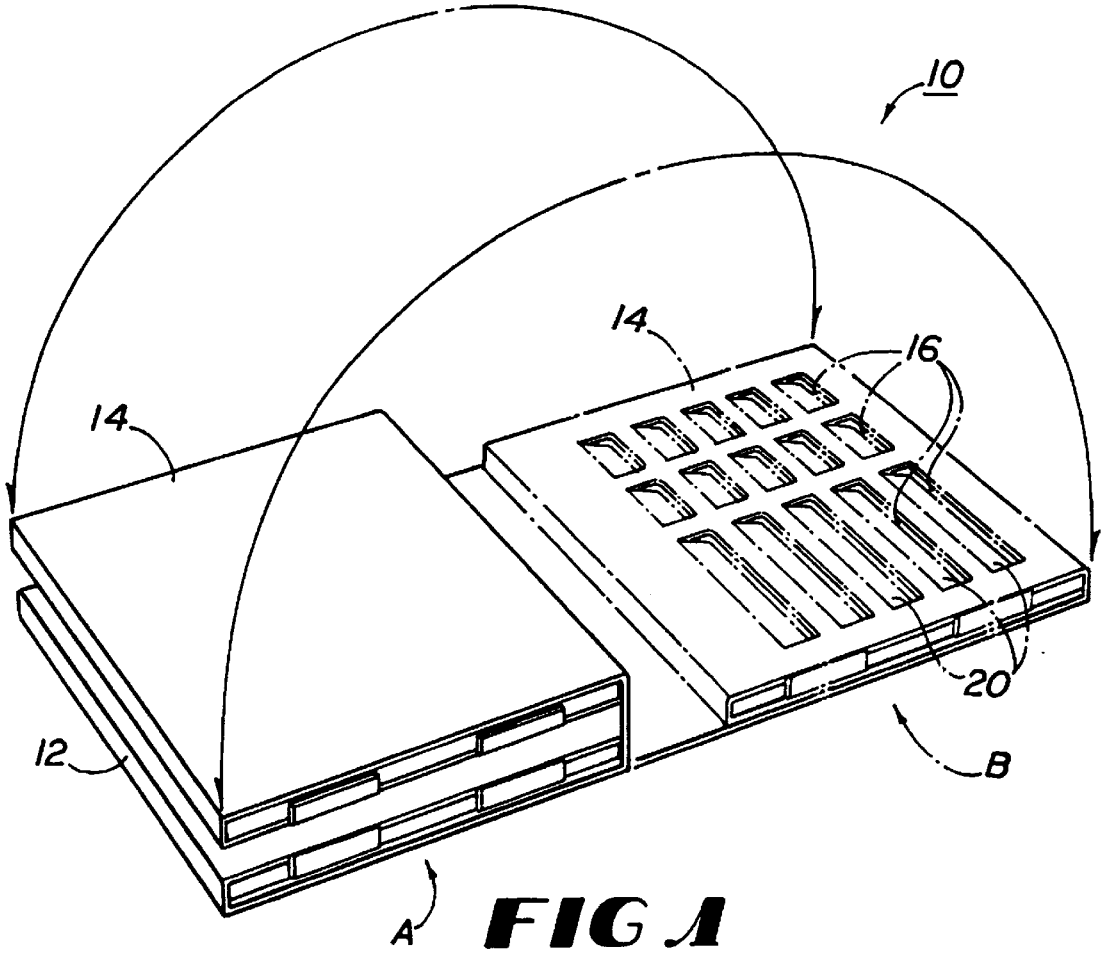
FIG. 1 is a perspective view of a carpet sample book of the present invention in open and closed positions.

FIG. 1 shows a carpet sample book 10 in accordance with the present invention. Book 10 comprises two pages 12, 14, which may be folded together, as in position A, or spread open, as in position B. Book 10 may be constructed from a single sheet of suitable material, including, but not limited to, cardboard, fiberboard, corrugated pasteboard, corrugated plastic board or any other suitable material. The sheet is folded and affixed in the desired shape, as discussed in detail below.

Figure 2:
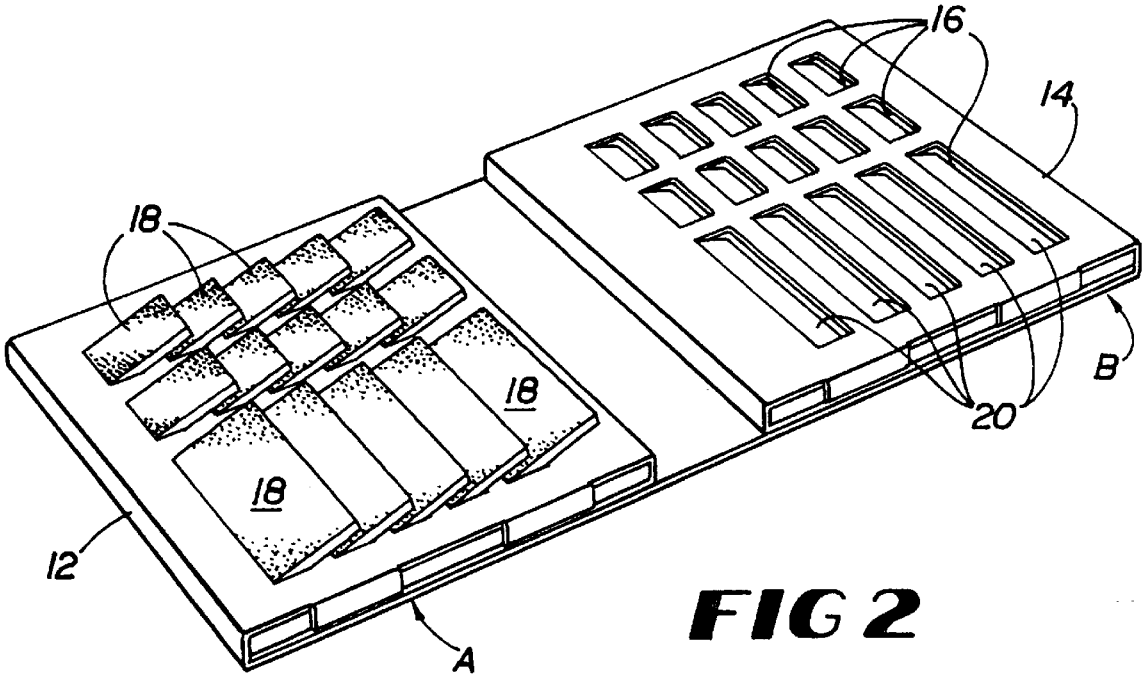
FIG. 2 is a perspective view of the carpet sample book of FIG. 1 in the open position with carpet samples inserted in one page.
Figure 3:
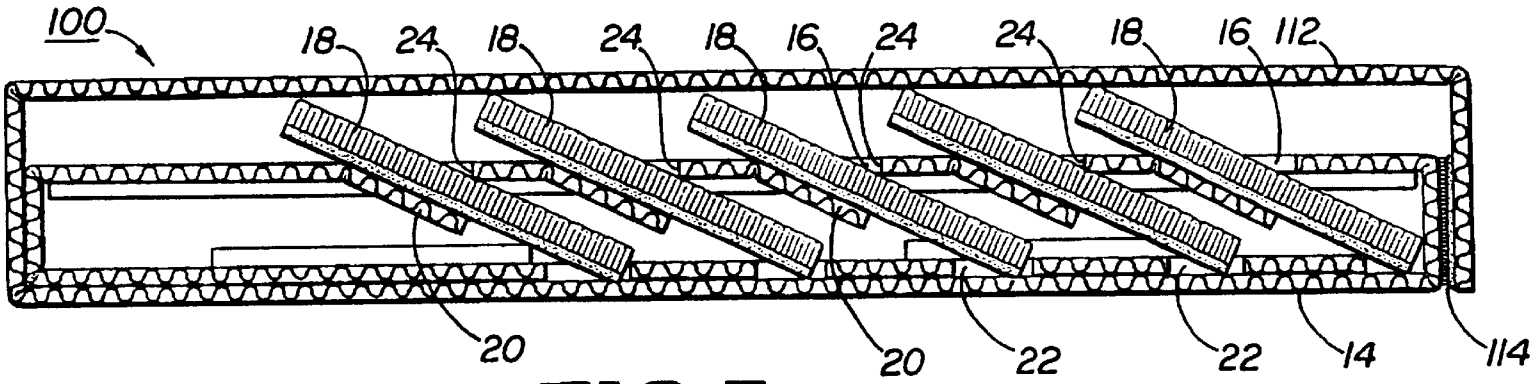
FIG. 3 is an end elevation view, partially in section, of an alternative embodiment of a carpet sample book according to the invention.

A number of slots 16 may be provided in the face of each page 12, 14. Slots 16 may be varied in size to allow the display of different sized carpet samples 18 (not shown). Slots 16 are formed by making a"C" shaped incision in the face of the page so that a louvers 20 are formed. As shown in FIG. 2, carpet samples 18 may be inserted into slots 16 so that they are displayed at an angle. As shown in FIGS. 3 (showing an alternative embodiment, discussed below), 4 and 4A, carpet samples 18 rest against louvers 20 and are urged thereby against edges 24 of slots 16 and, in that manner, are held securely within slot 16. The bottom edge of carpet samples 18 may rest in cutouts 22 which may be provided in pages 12, 14.

Figure 4:
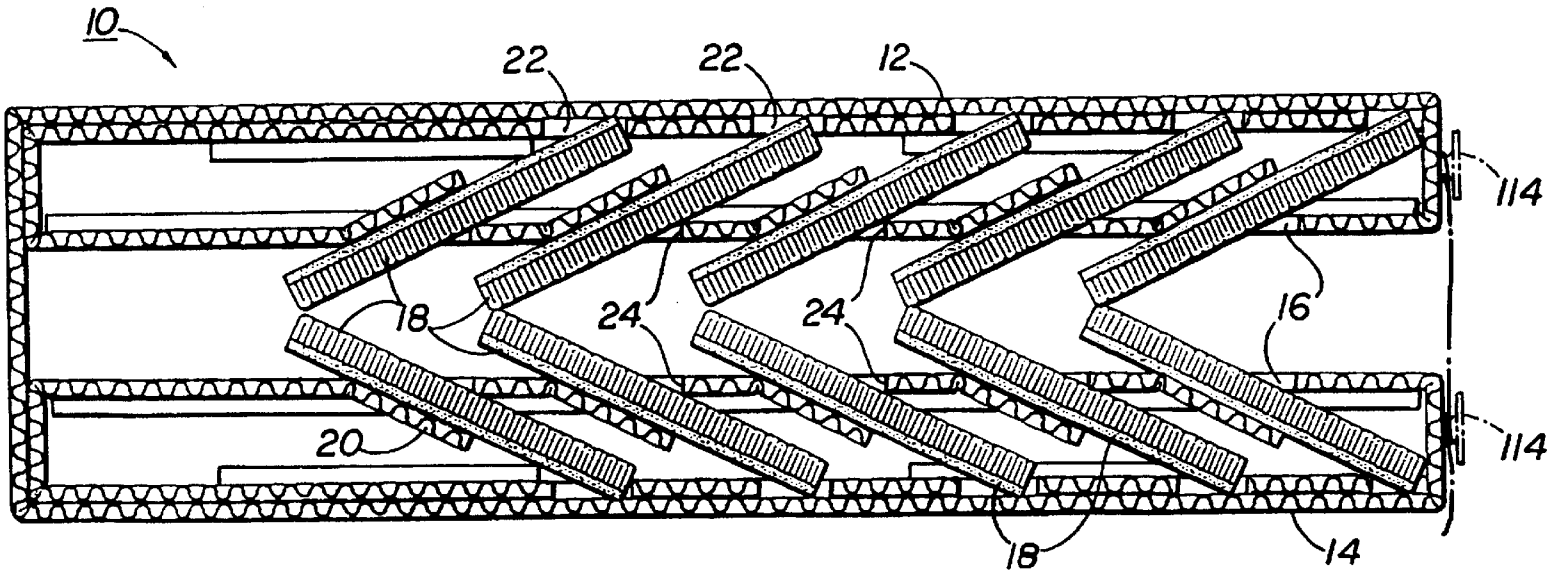
FIG. 4 is an end elevation view, partially in section, of the carpet sample book of FIG. 1.
Figure 4A:
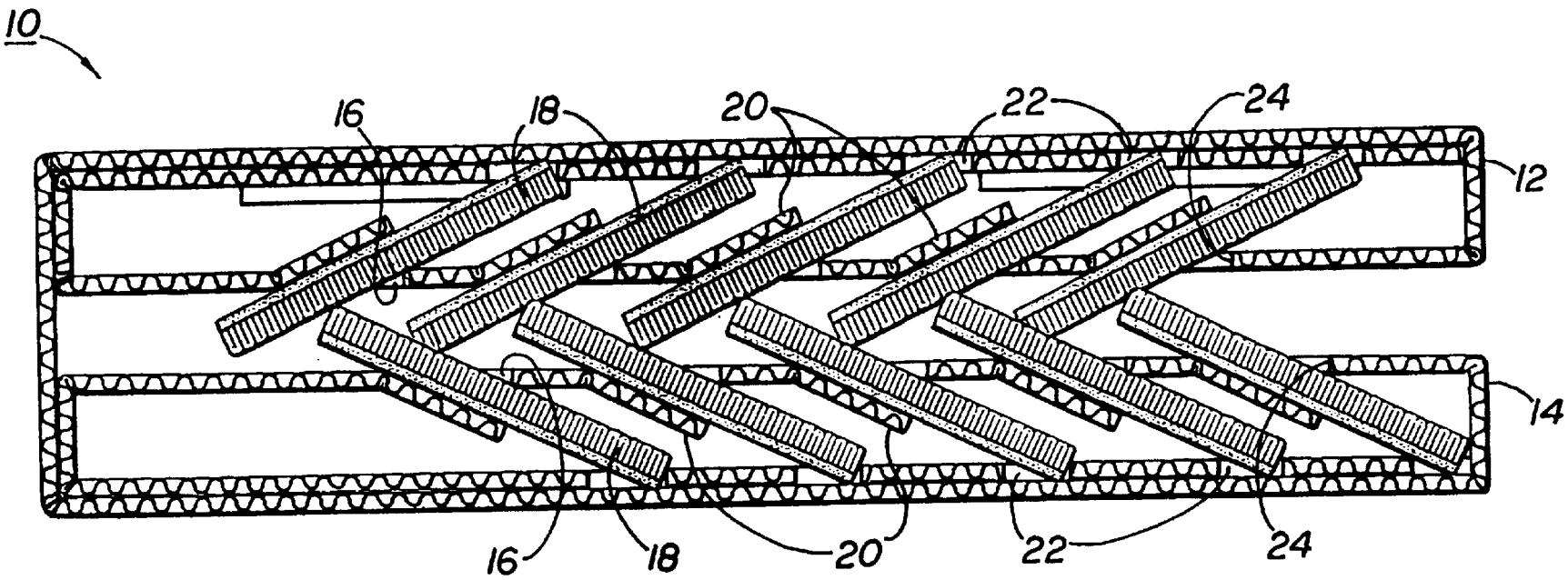
FIG. 4A is an end elevation view, partially in section, of an alternative embodiment of the carpet sample book of FIG. 1.

As shown in FIG. 4A, slots 16 may be positioned so that carpet samples 18 may be aligned in a"herringbone" pattern which allows pages 12, 14 of book 10 close together more closely. The herringbone arrangement also makes the closed book 10 more stable as pages 12,14 are less likely to slide about with respect to each other.

FIG. 3 illustrates an alternative embodiment of a carpet sample book according to the present invention. Book 100 comprises page 14 and cover flap 112. Book 100 allows samples 18 to be carried on only one page (14) while providing a cover which helps retain and protect samples 18 while book 100 is in transit.

As Shown in FIGS. 3 and 4, closures 114 may be provided on books 10, 100 which allow books 10, 100 to be held in a closed position during storage and transport. As shown in FIG. 3, a hook and loop fastener, such as Velcro®, may be used for closure 114. Alternatively, as shown in FIG. 4, a string and button closure may be used for fastener 114. Other closures or fasteners may be used as appropriate.

Figure 8:
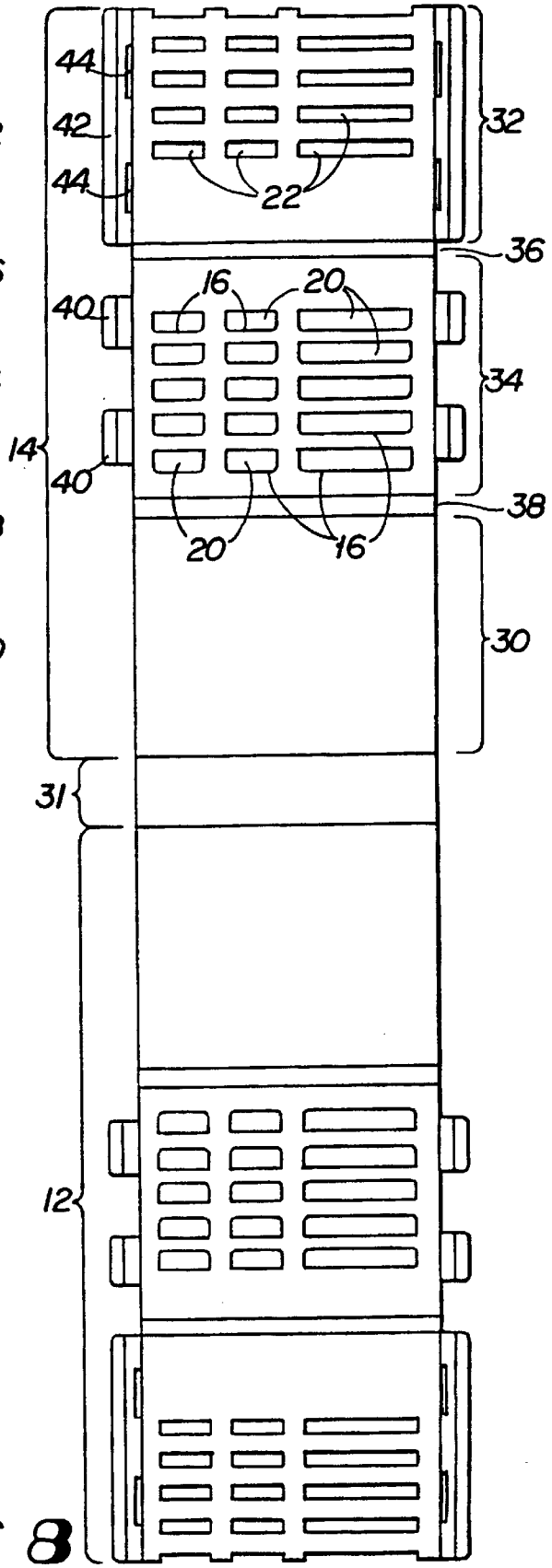
FIG. 8 is a plan view of the carpet sample book of FIG. 1 fully disassembled.

FIGS. 5–8 illustrate the assembly of books 10, 100. Because book 100 is identical in construction to book 10, except that only one page is provided, the following description will be directed to the construction of book 10. Referring to FIG. 8, book 10 is made up of a single sheet of cardboard laterally creased to define spine 31, narrow page ends 36 and 38, blank rectangular plate 30, face plate 34 and backer plate 32. Face plate 34 has one or more flaps 40. Backer plate 32 has foldouts 42 with slots 44 extending from each side.

Figure 5:
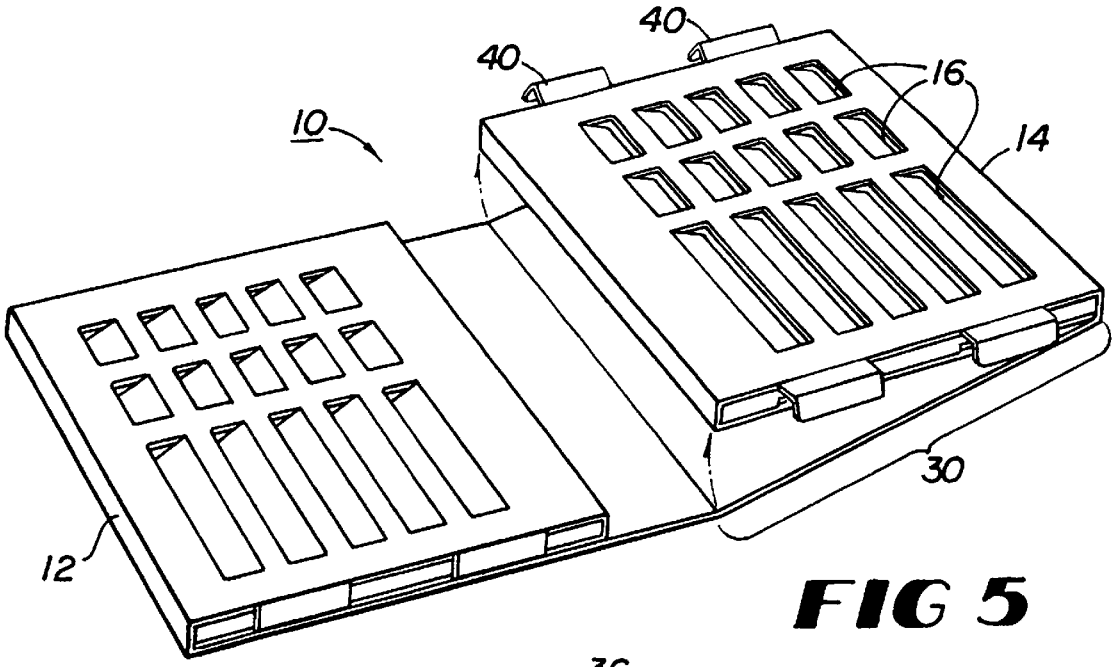
FIG. 5 is a perspective view of the carpet sample book of FIG. 1 in the open position with one page disassembled.
Figure 6:
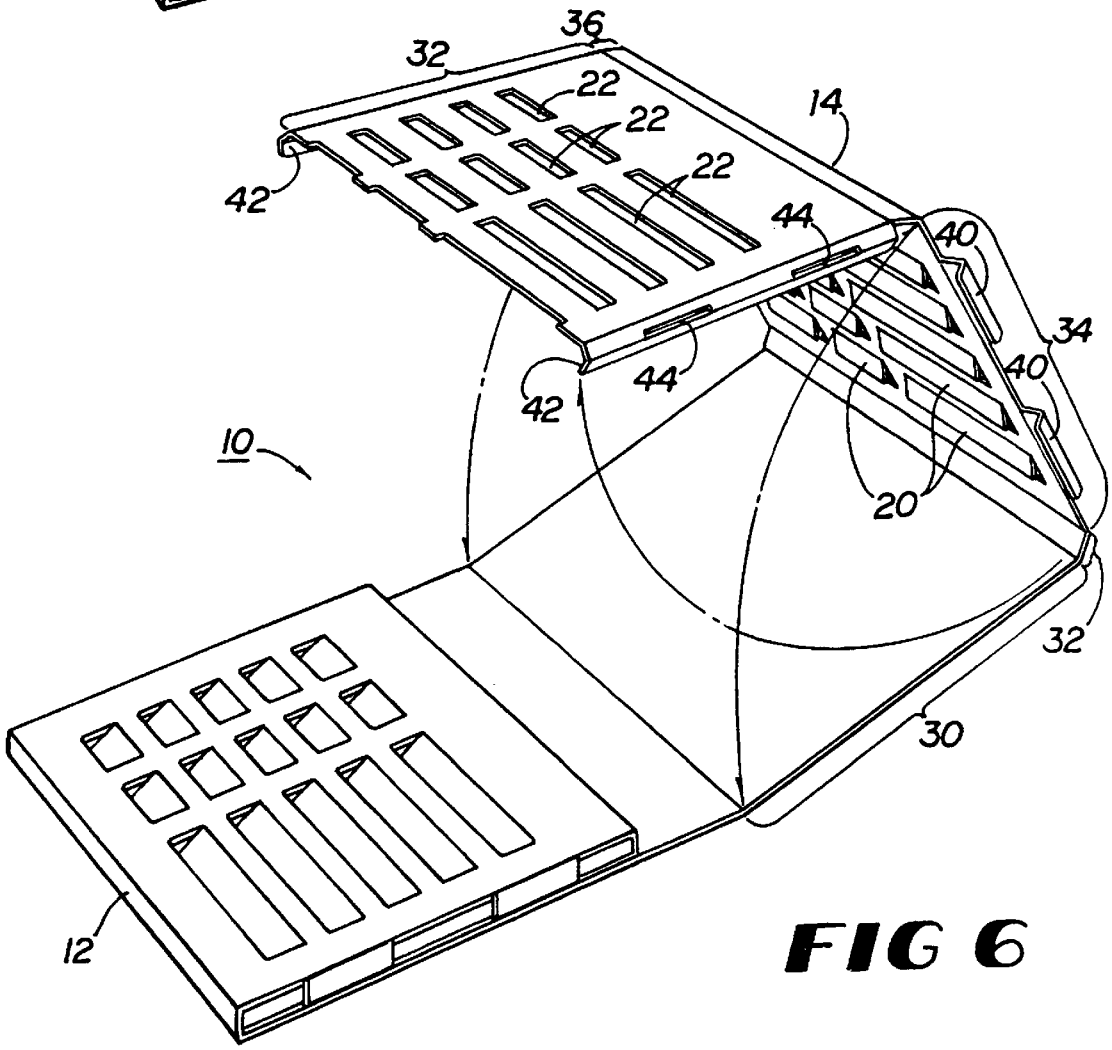
FIG. 6 is a perspective view of the carpet sample book of FIG. 1 in the open position with one page further disassembled.
Figure 7:
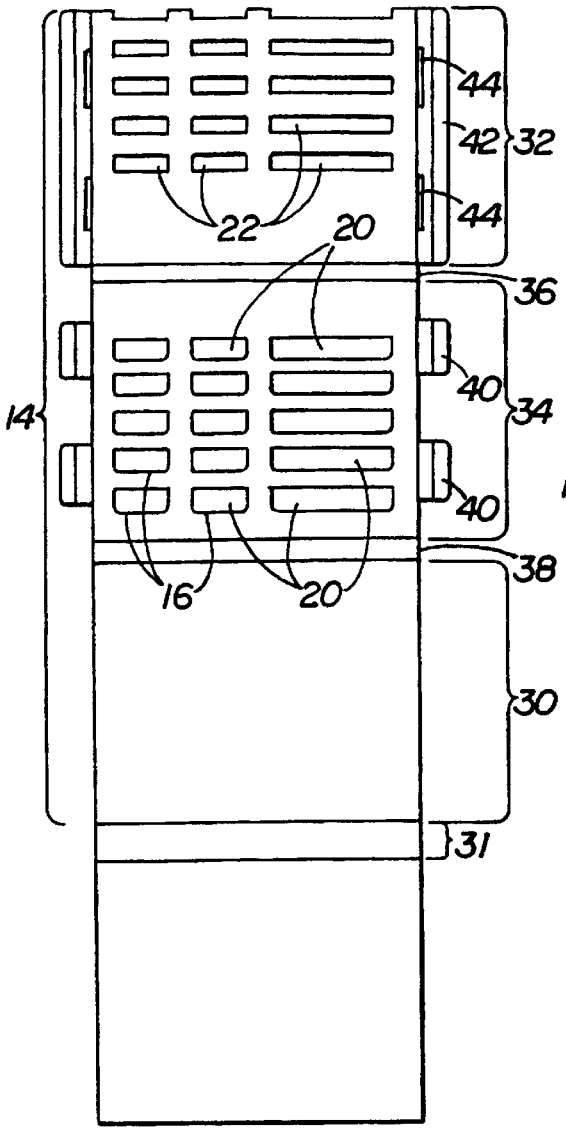
FIG. 7 is a plan view of the carpet sample book of FIG. 3 fully disassembled.

Slots 44 correspond with the positions of flaps 40 so that when page 14 is assembled, i.e., folded into its final form, flaps 40 may be inserted into slots 44, thereby holding sections 32 and 34 against each other in the folded position. FIGS. 5 and 6 illustrate book 10 with page 14 being disassembled, thus illustrating the manner in which the creases act as hinges and the interaction of slots 44 and flaps 40. Of course, foldouts 42 and flaps 40, may be positioned differently or other assembly means may provided and still provide the desired assembly of book 10. For instance, foldouts 42 may be formed on face plate 34 and flaps 40 may be positioned on backing plate 32. Likewise, face plate 34 may have foldout 42 on one side and flaps 40 on the other, with a complimentary arrangement on backing plate 32.

FIG. 6 illustrates a book 100 which has only one page 112. In lieu of a second page, book 100 has a flap 114 which covers and protects carpet samples 18 (not shown) when book 100 is not in use.

Although the foregoing is provided for purposes of illustrating, explaining and describing certain embodiments of the carpet sample book in particular detail, modifications and adaptations to the described books and other embodiments will be apparent to those skilled in the art and may be made without departing from the scope or spirit of the invention.

What is claimed is:

1. A sample book comprising:

a single sheet of cardboard which comprises;

a first page having a first display surface defining a first display slot and a first louver for retaining a sample in the display, the first page is formed by defining on the sheet first, second and third plates, a first narrow page end between the first and second plates, a second narrow page end between the second and third plates, at least one flap on an edge of the second plate and at least one slot proximate to the edge of the third plate and folding the sheet along intersections between the plates and the ends such that the flap lies proximate to and may be inserted into the slot; and a second page having a second display surface defining a second display slot and a second louver.

2. A sample book for displaying carpet samples comprising:

a) a sheet defining a spine, first, second and third plates, a first page end between the first and second plates, a second page end between the second and third plates, a first at least one tab on an edge of the second plate and a first at least one slot proximate to the edge of the third plate;

i) in which the position of the first at least one tab and the position of the first at least one slot correspond such that folding the sheet about the second page end aligns the first at least one tab and first at least one slot; and ii) n which the second plate defines at least one "C" shaped perforation.

3. The sample book of claim 2 in which the third plate defines at least one cutout.

4. The sample book of claim 2 in which the sheet further defines:

a) fourth, fifth and sixth plates, a third page end between the fourth and fifth plates, a fourth page end between the fifth and sixth plates, a second at least one tab on an edge of the fifth plate and a second at least one slot proximate to the edge of the sixth plate;

i) in which the position of the second at least one tab and the position of the second at least one slot correspond such that folding the sheet about the fourth page end aligns the tab and slot;

ii) in which the fifth plate defines at least one "C" shaped perforation; and b) in which the fourth plate is adjacent to the first plate.

5. The sample book of claim 3 in which the sixth panel defines at least one cutout.

6. The sample book of claim 4 in which the sheet is cardboard.

7. The sample book of claim 4 further comprising a closure means affixed the first page end and a corresponding closure means affixed to the third page end.

8. A blank for making a carpet sample book comprising a rectangular sheet of corrugated cardboard having ten lateral creases defining a centrally located spine and, on each side of the spine:

a) a blank rectangular plate;

b) a first narrow page end;

c) a face plate perforated by a plurality of "C" shaped slits;

d) a second narrow page end; and e) a backer plate perforated by a plurality of rectangular holes.

9. The blank of claim 8 further comprising:

a) at least one flap protruding from the face plate; and b) at least one foldout protruding from the backer plate having at least one slot defined therein for receiving the flap.

* * * * *

UNITED STATES PATENT AND TRADEMARK OFFICE

CERTIFICATE OF CORRECTION

PATENT NO. : 6,253,922 B1
DATED : July 3, 2001
INVENTOR(S) : James W. Hadden

It is certified that error appears in the above-identified patent and that said Letters Patent is hereby corrected as shown below:

Column 4,
Line 20, delete "n" and insert -- in --.

Signed and Sealed this

Fourth Day of June, 2002

*Attest:*

*Attesting Officer*

JAMES E. ROGAN
*Director of the United States Patent and Trademark Office*